US010227757B2

(12) United States Patent
Mott

(10) Patent No.: US 10,227,757 B2
(45) Date of Patent: Mar. 12, 2019

(54) SINK ACCESSORIZING DEVICE

(71) Applicant: Sharon Mott, Ludington, MI (US)

(72) Inventor: Sharon Mott, Ludington, MI (US)

( * ) Notice: Subject to any disclaimer, the term of this patent is extended or adjusted under 35 U.S.C. 154(b) by 0 days.

(21) Appl. No.: 15/660,630

(22) Filed: Jul. 26, 2017

(65) Prior Publication Data

US 2019/0032310 A1 Jan. 31, 2019

(51) Int. Cl.

| | |
|---|---|
| ***A61H 33/08*** | (2006.01) |
| ***A61H 33/12*** | (2006.01) |
| ***E03C 1/04*** | (2006.01) |
| ***E03C 1/044*** | (2006.01) |
| ***A47K 10/48*** | (2006.01) |
| ***A61H 35/00*** | (2006.01) |

(52) U.S. Cl.

CPC ..... *E03C 1/0405* (2013.01); *A47K 10/48* (2013.01); *A61H 33/08* (2013.01); *A61H 33/12* (2013.01); *A61H 35/00* (2013.01); *A61H 35/008* (2013.01); *E03C 1/044* (2013.01)

(58) Field of Classification Search

CPC ..... E03C 1/0405; E03C 1/044; A47K 10/48; A61H 35/0008; A61H 35/04; A61H 35/002; A61H 33/12; A61H 33/08; A61H 33/06; A61H 33/6036

USPC ..... 4/615, 537, 654, 515–523; 601/160, 155

See application file for complete search history.

(56) References Cited

U.S. PATENT DOCUMENTS 533,588 A * 2/1895 Goodman ..... A61H 33/12 4/537
1,597,855 A * 8/1926 Zahorsky ..... A45D 24/32 132/112
1,653,901 A * 12/1927 Haessly ..... A61F 7/007 219/240
1,982,259 A * 11/1934 Martin ..... A61H 33/025 4/541.4
3,530,852 A * 9/1970 Fattor ..... A61H 33/027 601/155
3,581,998 A * 6/1971 Roche ..... E03C 1/046 239/310
3,702,616 A * 11/1972 Mercer ..... A45D 20/50 132/112
3,973,279 A * 8/1976 Giffen ..... A47K 1/04 206/581
4,034,201 A * 7/1977 Walter ..... A45D 1/04 132/112
4,863,103 A 9/1989 Gannaway
5,014,919 A 5/1991 Knapp
5,070,864 A * 12/1991 Lemons ..... A61H 23/04 239/383

(Continued)

*Primary Examiner* — Erin Deery

(57) ABSTRACT

A sink accessorizing device for washing and drying a user's face includes a spray head that is configured to fluidically couple to a mixing valve of a sink. The spray head is configured to convert water that flows from the mixing valve to a mist and to emit the mist from a front of the spray head. A blower assembly is fluidically coupled to the spray head. The blower assembly is configured to operationally couple to an electrical circuit. The blower assembly is configured to heat and force air through the front of the spray head. A selector is operationally coupled to the spray head and the blower assembly. The selector is positioned to selectively compel the spray head to emit the mist to moisten a face of a user and to force the air through the front of the spray head to dry the face of the user.

12 Claims, 4 Drawing Sheets

(56) References Cited

U.S. PATENT DOCUMENTS

| | | | | |
|---|---|---|---|---|
| 6,186,988 | B1 * | 2/2001 | Sabacinski | A61M 3/025 137/893 |
| 6,270,278 | B1 | 8/2001 | Mauro | |
| 6,612,507 | B1 * | 9/2003 | Meyer | A46B 11/06 239/390 |
| 6,843,432 | B1 * | 1/2005 | Philpott | A47K 7/08 239/289 |
| 6,880,768 | B2 | 4/2005 | Lau | |
| D519,604 | S | 4/2006 | Swain | |
| 2007/0261163 | A1 | 11/2007 | Lynam | |
| 2013/0248010 | A1 | 9/2013 | Reiman | |
| 2015/0189966 | A1 * | 7/2015 | Kim | A45D 19/14 4/517 |

* cited by examiner

SINK ACCESSORIZING DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR Not Applicable

(g) BACKGROUND OF THE INVENTION

(1) Field of the Invention

(2) Description of Related Art Including Information Disclosed Under 37 CFR 1.97 and 1.98

The disclosure and prior art relates to sink accessorizing devices and more particularly pertains to a new sink accessorizing device for washing and drying a user's face.

(h) BRIEF SUMMARY OF THE INVENTION

An embodiment of the disclosure meets the needs presented above by generally comprising a spray head that is configured to fluidically couple to a mixing valve of a sink. The spray head is configured to convert water that flows from the mixing valve to a mist and to emit the mist from a front of the spray head. A blower assembly is fluidically coupled to the spray head. The blower assembly is configured to operationally couple to an electrical circuit. The blower assembly is configured to heat and force air through the front of the spray head. A selector is operationally coupled to the spray head and the blower assembly. The selector is positioned to selectively compel the spray head to emit the mist to moisten a face of a user and to force the air through the front of the spray head to dry the face of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
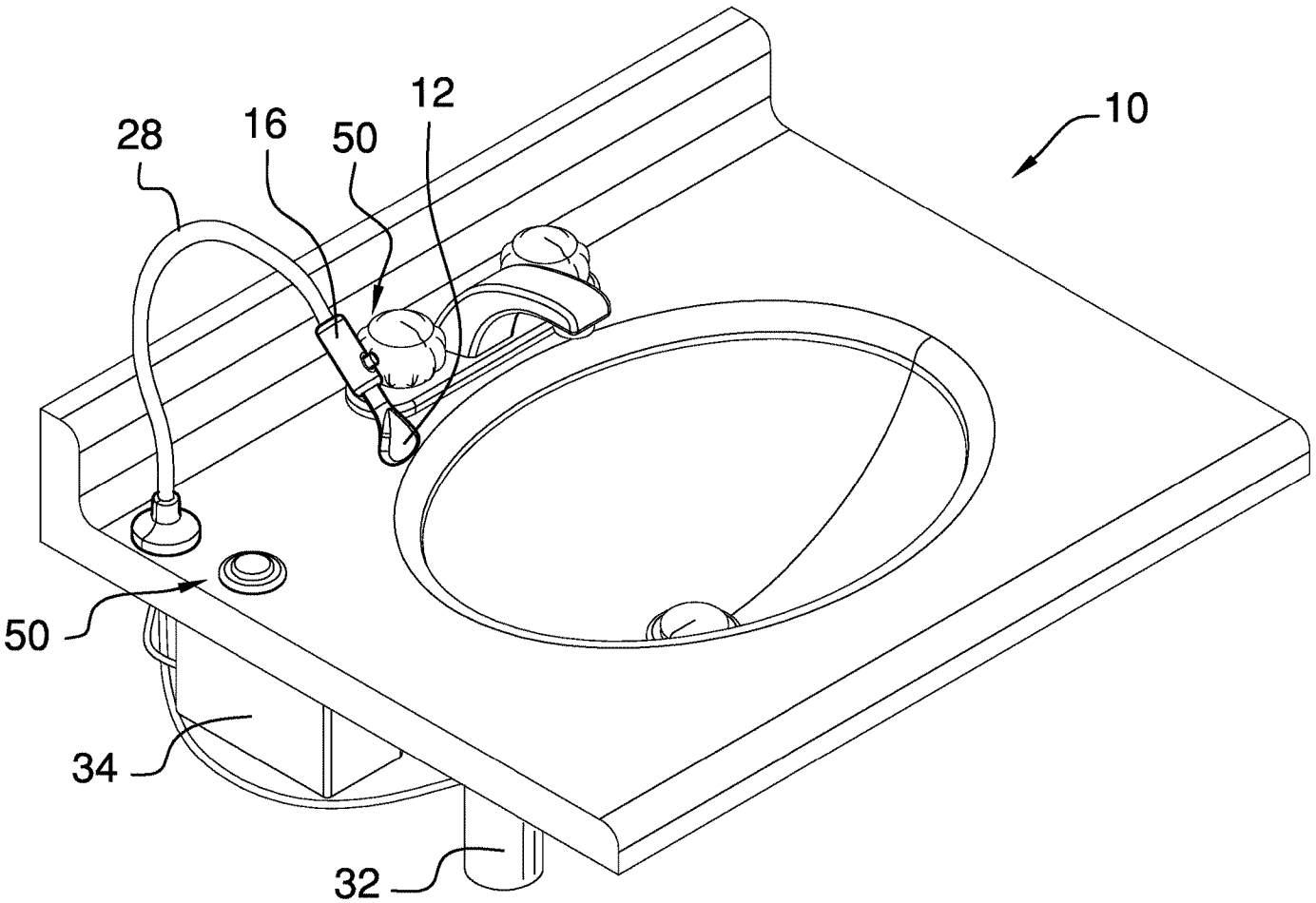
FIG. 1 is an isometric perspective view of a sink accessorizing device according to an embodiment of the disclosure.
Figure 2:
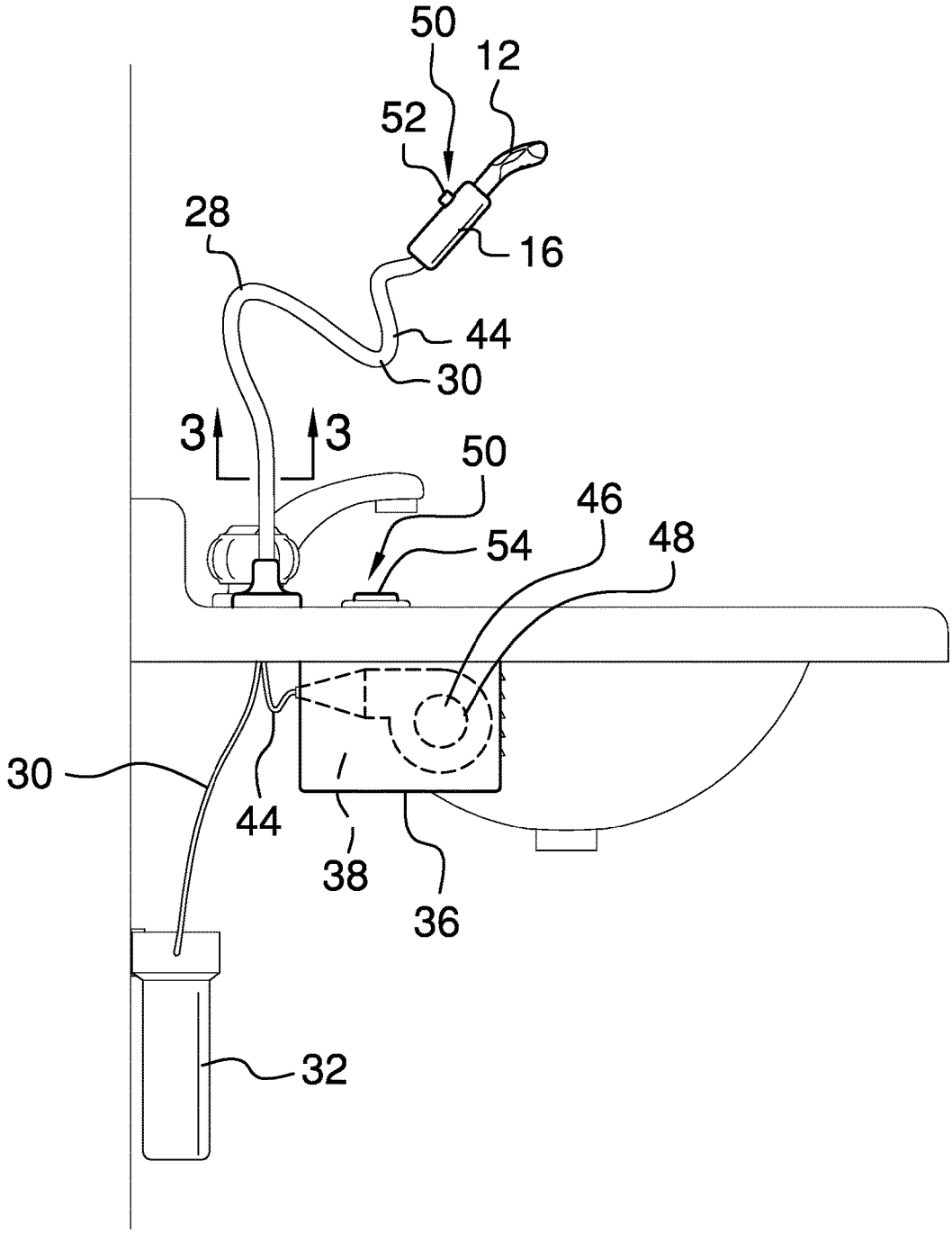
FIG. 2 is a side view of an embodiment of the disclosure.
Figure 3:
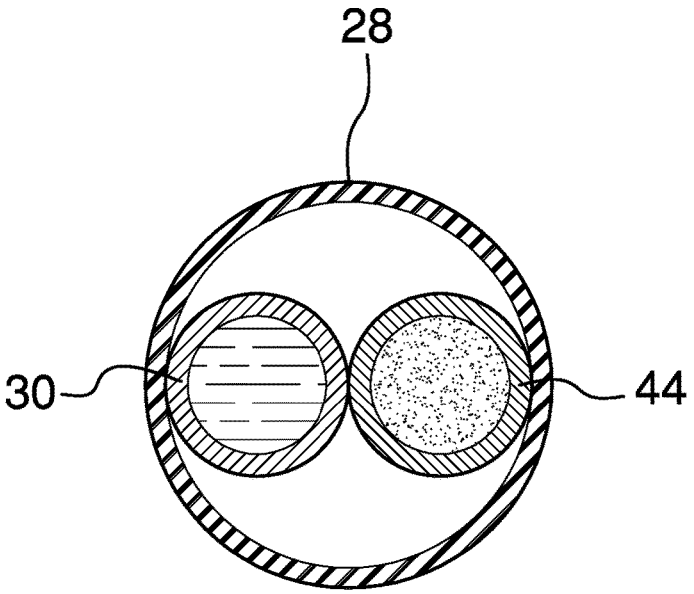
FIG. 3 is a cross-sectional view of an embodiment of the disclosure.
Figure 4:
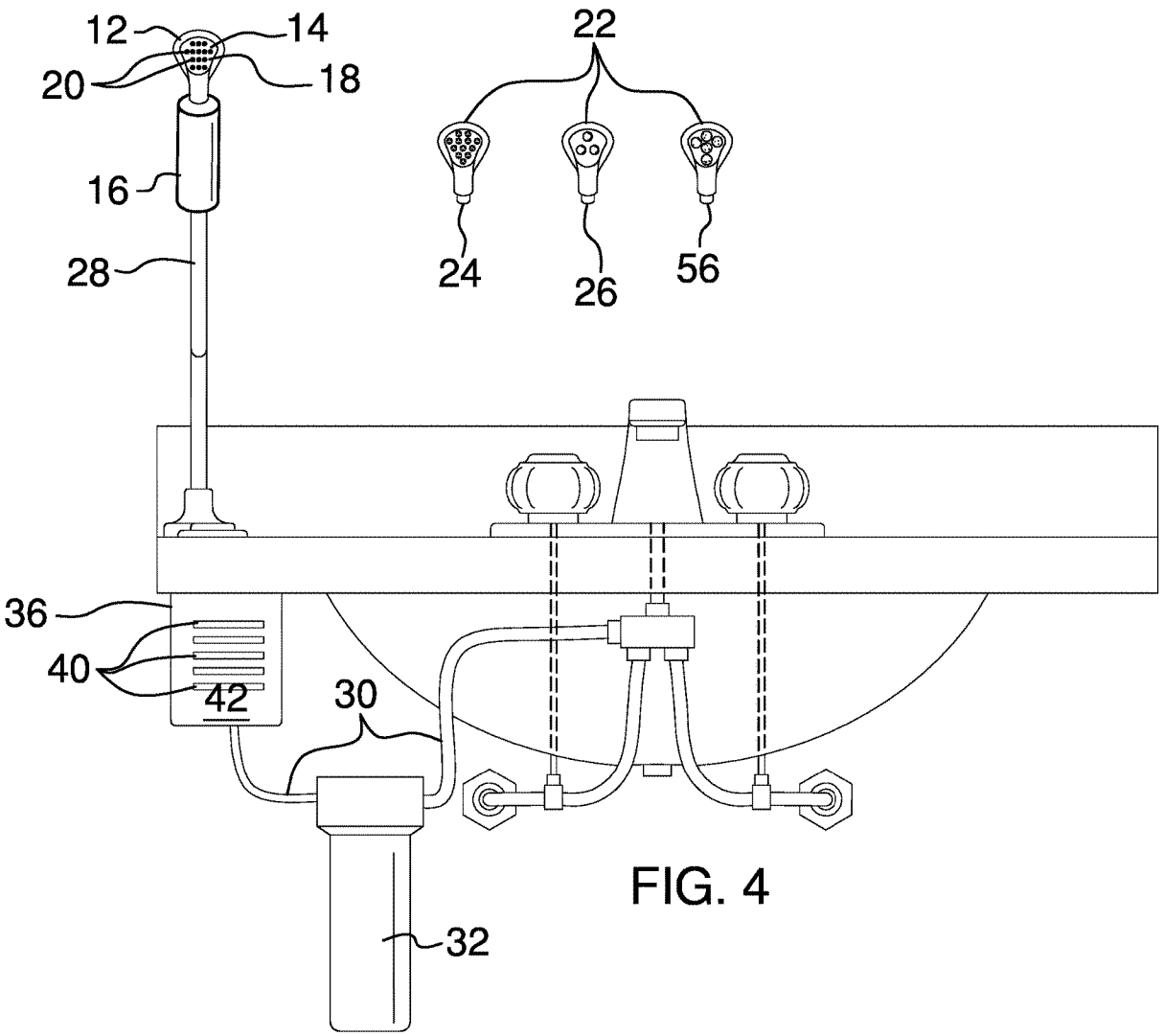
FIG. 4 is a detail view of an embodiment of the disclosure.

With reference now to the drawings, and in particular to FIGS. 1 through 4 thereof, a new sink accessorizing device embodying the principles and concepts of an embodiment of the disclosure and generally designated by the reference numeral 10 will be described.

As best illustrated in FIGS. 1 through 4, the sink accessorizing device 10 generally comprises a spray head 12 that is configured to fluidically coupled to a mixing valve of a sink, such as a wash basin is positioned in a bathroom. The spray head 12 is configured to convert water that flows from the mixing valve to the spray head 12 to a mist and to emit the mist from a front 14 of the spray head 12 to moisten a face of a user.

A handle 16 is coupled to the spray head 12. The handle 16 is configured to be grasped in a hand of the user to position the spray head 12 proximate to the face of the user. In one embodiment, the handle 16 is cylindrically shaped.

A plate 18 is reversibly couplable to the front 14 of the spray head 12. The plate 18 is selectively removable from the spray head 12 to be cleaned and replaced. In one embodiment, the plate 18 comprises stainless steel. A plurality of holes 20 is positioned through the plate 18. The holes 20 are configured to convert the water that flows from the mixing valve to the spray head 12 to the mist and to emit the mist from the plate 18.

Each of a plurality of attachments 22 is selectively couplable to the front 14 of the spray head 12. Each attachment 22 has a respective function so that the plurality of attachments 22 has a variety of functions, such as brushing, buffing and massaging. In one embodiment, the plurality of attachments 22 comprises at least one brush 24, at least one buffer 56, and at least one massager 26.

A hose 28 is coupled to and extends from the handle 16. The hose 28 is configured to couple to a top of the sink. In one embodiment, the hose 28 is configured to be selectively extended from the sink.

A first tube 30 is fluidically coupled to the spray head 12 and the mixing valve of the sink. The first tube 30 is positioned through the hose 28. The first tube 30 is configured to allow the water to flow from the mixing valve to the spray head 12. A filter assembly 32 is positioned in-line with the first tube 30. The filter assembly 32 is configured to filter the water that flows from the mixing valve to the spray head 12.

A blower assembly 34 is fluidically coupled to the spray head 12. The blower assembly 34 is configured to operationally couple to an electrical circuit and to couple to the sink. The blower assembly 34 is configured to heat air and to force the air through the front 14 of the spray head 12 to dry the face of the user.

In one embodiment, the blower assembly 34 comprises a housing 36 that is configured to couple to an underside of the sink. The housing 36 defines an interior space 38. In one embodiment, the housing 36 is substantially rectangularly box shaped. A plurality of slits 40 is positioned through a face 42 of the housing 36. The slits 40 are configured to allow the air to flow into the housing 36. A second tube 44 is fluidically coupled to and extends between the housing 36 and the spray head 12. The second tube 44 is positioned in the hose 28.

A heater 46 is coupled to the housing 36 and is positioned in the interior space 38. The heater 46 is configured to warm the air that enters the interior space 38 through the slits 40. A fan 48 is coupled to the housing 36 and is positioned in the interior space 38. The fan 48 is configured to motivate the air that is warmed by the heater 46 through the second tube 44 to the spray head 12.

A selector 50 is operationally coupled to the spray head 12 and the blower assembly 34. The selector 50 is positioned to selectively compel the spray head 12 to emit the mist to moisten the face of the user and to force the air through the front 14 of the spray head 12 to dry the face of the user.

In one embodiment, the selector 50 comprises a first button 52 a second button 54. The first button 52 is positioned on the handle 16 and is operationally coupled to the spray head 12. The first button 52 is configured to be depressed to selectively compel the spray head 12 to emit the mist to moisten the face of the user. The second button 54 is configured to couple to the sink. The second button 54 is operationally coupled to the blower assembly 34. The second button 54 is configured to be depressed to compel the blower assembly 34 to force the air through the front 14 of the spray head 12 to dry the face of the user.

In use, the handle 16 configured to be grasped in the hand of the user to position the spray head 12 proximate to the face of the user. The plate 18 that is positioned on the spray head 12 is selectively removable from the spray head 12 to be cleaned and replaced. The holes 20 that are positioned in the plate 18 are configured to convert the water that flows from the mixing valve to the spray head 12 to the mist and to emit the mist from the plate 18. The first tube 30 is configured to allow the water to flow of from the mixing valve to the spray head 12. The filter assembly 32 is configured to filter the water that flows from the mixing valve to the spray head 12. The slits 40 that are positioned in through the face 42 of the housing 36 are configured to allow the air to flow into the housing 36. The heater 46 is configured to warm the air that enters the interior space 38 through the slits 40. The fan 48 is configured to motivate the air that is warmed by the heater 46 through the second tube 44 to the spray head 12. The first button 52 that is positioned on the handle 16 is configured to be depressed to selectively compel the spray head 12 to emit the mist to moisten the face of the user. The second button 54 that is positioned on the sink is configured to be depressed to compel the blower assembly 34 to force the air through the front 14 of the spray head 12 to dry the face of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sink spray head device comprising:

a spray head configured for fluidically coupling to a mixing valve of a sink, said spray head being configured for converting water flowing from the mixing valve to said spray head to a mist and emitting the mist from a front of said spray head for moistening a face of a user;

a blower assembly fluidically coupled to said spray head, said blower assembly being configured for operationally coupling to an electrical circuit and for coupling to the sink, said blower assembly being configured for heating air and for forcing the air through said front of said spray head for drying the face of the user;

a selector operationally coupled to said spray head and said blower assembly;

a handle coupled to said spray head, wherein said handle is positioned on said spray head such that said handle is configured for grasping in a hand of the user for positioning said spray head proximate to the face of the user;

a hose coupled to and extending from said handle, said hose being configured for coupling to a top of the sink;

a first tube fluidically coupled to said spray head and configured for coupling to the mixing valve of the sink, said first tube being positioned through said hose, wherein said first tube is coupled to said spray head such that said first tube is configured for flowing of the water from the mixing valve to said spray head; and wherein said selector is positioned for selectively activating said spray head.

2. The device of claim 1, further including said handle being cylindrically shaped.

3. The device of claim 1, further comprising:

a plate removably couplable to said front of said spray head;

a plurality of holes positioned through said plate; and wherein said plate is positioned on said spray head such that said plate is selectively removable from said spray head for cleaning and replacing, wherein said plurality of holes is positioned in said plate such that said plurality of holes is configured for converting the water flowing from the mixing valve to said spray head to the mist and emitting the mist from said plate.

4. The device of claim 3, further including said plate comprising stainless steel.

5. The device of claim 1, further including a plurality of attachments, said attachments being selectively couplable to said front of said spray head, each attachment having a respective function such that said plurality of attachments has a variety of functions.

6. The device of claim 5, further including said plurality of attachments comprising at least one brush, at least one buffer, and at least one massager.

7. The device of claim 1, further including said hose being configured for selectively extending from the sink.

8. The device of claim 1, further including a filter assembly positioned in-line with said first tube, wherein said filter assembly is coupled to said first tube such that said filter assembly is configured for filtering the water flowing from the mixing valve to said spray head.

9. The device of claim 1, further including said blower assembly comprising:

a housing configured for coupling to an underside of the sink, said housing defining an interior space;

a plurality of slits positioned through a face of said housing;

a second tube fluidically coupled to and extending between said housing and said spray head, said second tube being positioned in said hose;

a heater coupled to said housing and positioned in said interior space;

a fan coupled to said housing and positioned in said interior space; and wherein said slits are positioned through said face of said housing such that said slits are configured for flowing of the air into said housing, wherein said heater is positioned in said housing such that said heater is configured for warming the air entering said interior space through said slits, wherein said fan is positioned in said housing such that said fan is configured for motivating the air warmed by said heater through said second tube to said spray head.

10. The device of claim 9, further including said housing being substantially rectangularly box shaped.

11. The device of claim 1, further including said selector comprising:

a first button being positioned on said handle, said first button being operationally coupled to said spray head;

a second button configured for coupling to the sink, said second button being operationally coupled to said blower assembly; and wherein said first button is positioned on said handle such that said first button is configured for depressing for selectively compelling said spray head for emitting the mist for moistening the face of the user, wherein said second button is configured to be positioned on the sink such that said second button is configured for depressing for compelling said blower assembly for forcing the air through said front of said spray head for drying the face of the user.

12. A sink spray head device comprising:

a spray head configured for fluidically coupling to a mixing valve of a sink, said spray head being configured for converting water flowing from the mixing valve to said spray head to a mist and emitting the mist from a front of said spray head for moistening a face of a user;

a handle coupled to said spray head, wherein said handle is positioned on said spray head such that said handle is configured for grasping in a hand of the user for positioning said spray head proximate to the face of the user, said handle being cylindrically shaped;

a plate removably couplable to said front of said spray head, wherein said plate is positioned on said spray head such that said plate is selectively removable from said spray head for cleaning and replacing, said plate comprising stainless steel;

a plurality of holes positioned through said plate, wherein said plurality of holes is positioned in said plate such that said plurality of holes is configured for converting the water flowing from the mixing valve to said spray head to the mist and emitting the mist from said plate;

a plurality of attachments, said attachments being selectively couplable to said front of said spray head, each said attachment having a respective function such that said plurality of attachments has a variety of functions, said plurality of attachments comprising at least one brush, at least one buffer, and at least one massager, a hose coupled to and extending from said handle, said hose being configured for coupling to a top of the sink, said hose being configured for selectively extending from the sink;

a first tube fluidically coupled to said spray head and configured for coupling to the mixing valve of the sink, said first tube being positioned through said hose, wherein said first tube is coupled to said spray head such that said first tube is configured for flowing of the water from the mixing valve to said spray head;

a filter assembly positioned in-line with said first tube, wherein said filter assembly is coupled to said first tube such that said filter assembly is configured for filtering the water flowing from the mixing valve to said spray head;

a blower assembly fluidically coupled to said spray head, said blower assembly being configured for operationally coupling to an electrical circuit and for coupling to the sink, said blower assembly being configured for heating air and for forcing the air through said front of said spray head for drying the face of the user, said blower assembly comprising:

a housing configured for coupling to an underside of the sink, said housing defining an interior space, said housing being substantially rectangularly box shaped, a plurality of slits positioned through a face of said housing, wherein said slits are positioned through said face of said housing such that said slits are configured for flowing of the air into said housing, a second tube fluidically coupled to and extending between said housing and said spray head, said second tube being positioned in said hose, a heater coupled to said housing and positioned in said interior space, wherein said heater is positioned in said housing such that said heater is configured for warming the air entering said interior space through said slits, and a fan coupled to said housing and positioned in said interior space, wherein said fan is positioned in said housing such that said fan is configured for motivating the air warmed by said heater through said second tube to said spray head;

a selector operationally coupled to said spray head and said blower assembly, wherein said selector is positioned for selectively activating said spray head, said selector comprising:

a first button being positioned on said handle, said first button being operationally coupled to said spray head, wherein said first button is positioned on said handle such that said first button is configured for depressing for selectively compelling said spray head for emitting the mist for moistening the face of the user, and a second button configured for coupling to the sink, said second button being operationally coupled to said blower assembly, wherein said second button is configured to be positioned on the sink such that said second button is configured for depressing for compelling said blower assembly for forcing the air through said front of said spray head for drying the face of the user.

* * * * *